United States Patent [19]

Sawyer

[11] 4,373,354

[45] Feb. 15, 1983

[54] COMBINATION DISCHARGE GAS MUFFLER AND WATER HEATER

[75] Inventor: George N. Sawyer, 14 Bayview, Rte. 2, Flint, Tex. 75762

[73] Assignee: Trane CAC, Inc., La Crosse, Wis.

[21] Appl. No.: 306,024

[22] Filed: Sep. 28, 1981

[51] Int. Cl.[3] ..... F25B 27/02

[52] U.S. Cl. ..... 62/238.6; 62/296; 62/324.4; 237/2 B

[58] Field of Search ..... 62/296, 238.6, 324.4; 237/2 B

[56] References Cited

U.S. PATENT DOCUMENTS

| | | | |
|---|---|---|---|
| 1,684,186 | 9/1928 | Kysor | 165/51 |
| 2,108,671 | 2/1938 | Kato | 181/49 |
| 2,359,365 | 10/1944 | Katcher | 181/67 |
| 2,690,649 | 10/1954 | Borgerd | 62/4 |
| 2,716,866 | 9/1955 | Silva | 62/4 |
| 3,006,160 | 10/1961 | Heidorn | 62/296 |
| 3,188,829 | 6/1965 | Siewert et al. | 62/160 |
| 3,280,903 | 10/1966 | Stoddard, Jr. | 165/135 |
| 3,301,002 | 1/1967 | McGrath | 62/175 |
| 4,098,092 | 7/1978 | Singh | 62/238.6 |
| 4,142,379 | 3/1979 | Kuklinski | 62/238.6 X |
| 4,168,745 | 9/1979 | Lastinger | 165/164 |
| 4,226,606 | 10/1980 | Yaeger et al. | 62/238.6 |
| 4,351,159 | 9/1982 | Schumacher | 62/238.6 X |

*Primary Examiner*—Lloyd L. King

[57] ABSTRACT

A muffler for attenuating the sound of the hot refrigerant gas discharged from a hermetic refrigeration compressor and for transferring heat from the hot discharged refrigerant gas to a water tube arranged in heat exchange relationship with the muffler. The water tube is adapted to be connected to a water heater tank in a manner that recirculates water from the tank through the water tube in a closed circuit.

13 Claims, 2 Drawing Figures

COMBINATION DISCHARGE GAS MUFFLER AND WATER HEATER

BACKGROUND OF THE INVENTION

The present invention relates to a muffler for attenuating the sound of the gas discharged from a hermetic refrigeration compressor and, more particularly, to a muffler incorporating a water tube arranged in heat exchange relationship with the muffler wherein the water tube is connected to a water heater in a manner that circulates water from the water heater through the water tube in a closed circuit to heat the water.

It is common practice in refrigeration systems to provide mufflers or sound attentuating devices in the discharge line of motor compressors. Generally, these devices are constructed to have a volume and an extended flow path in order that sounds through a wide range of frequencies may be effectively deadened.

Inherent in the operation of an air-conditioning system or heat pump is the creation of waste heat which is normally dissipated to the atmosphere. Many prior art attempts have been made in utilizing this waste heat from the refrigeration system by providing heat exchange apparatus in which the hot refrigerant gas is passed in heat exchange relationship with water used interiorly of the house and which is normally heated by independent, energy-consuming means such as gas or electricity.

In some prior art systems employing a refrigeration system to heat water, such as U.S. Pat. Nos. 2,690,649—Borgerd; 3,301,002—McGrath; 3,188,829—Seiwert, the refrigeration system condenser or coils are immersed in the water tank. While this has proved to be reasonably satisfactory, it does present some problems such as the hazard of contaminating with refrigerant the water supply system connected to the hot water storage tank in the event of a rupture of the refrigerant condenser, since the condenser is directly immersed in the water stored in the tank. In one prior art attempt to heat water by employing waste heat from a refrigerator, U.S. Pat. No. 4,168,745 discloses a heat exchanger including a refrigerant tube in coil form leading from the output side of a compressor and a water tube in coil form tapped from a source of water to be heated, the tubes being coiled together so that each coil of water tube is interposed between a coil of refrigerant tube. These systems are primarily for the purpose of heating water and, accordingly, are connected with the refrigeration system solely for that purpose even though, inherently, once connected may lower the temperature of the refrigerant due to such heat exchange sufficient to make the refrigeration cycle more efficient.

Hot water heaters, such as that disclosed in U.S. Pat. No. 2,716,866—Silva, have been constructed to incorporate the refrigeration system in the tank assembly. This is obviously expensive since the refrigeration system functions to heat the water.

SUMMARY OF THE INVENTION

The present invention provides a muffler for use in a refrigeration system that includes heat exchange means adapted to be connected to a water souce. The refrigeration system includes a hermetic compressor, a condenser for condensing hot gaseous refrigerant discharged from the compressor, an evaporator for evaporating the condensed refrigerant, and the muffler incorporating the present invention. The muffler includes a cylindrical housing having cap portions closing each end thereof. The housing has an inlet connected to the discharge side of the compressor for receiving the hot gaseous refrigerant and an outlet connecting the muffler in series flow relationship in the refrigeration system. Arranged in the housing is a tubular casing having its longitudinal outer wall spaced from the interior wall of the housing. One cap of the casing has attached thereto an inlet that is connected to the housing inlet to divert the hot gaseous refrigerant into the interior of the casing. The other cap of the casing is provided with a plurality of outlet apertures for directing the hot gaseous refrigerant into the interior of the housing. Extending between the casing outer wall and the housing inner wall is a helical wall that forms a spiral passageway for the hot gaseous refrigerant between the outlet apertures of the casing and the outlet of the housing to return the hot gaseous refrigerant to the refrigerant system. To transfer the heat of the refrigerant from the muffler to the water, a water passageway that is connected to the water source is positioned in heat exchange relationship with the outer wall surface of the housing.

DETAILED DESCRIPTION OF THE INVENTION

Figure 1:
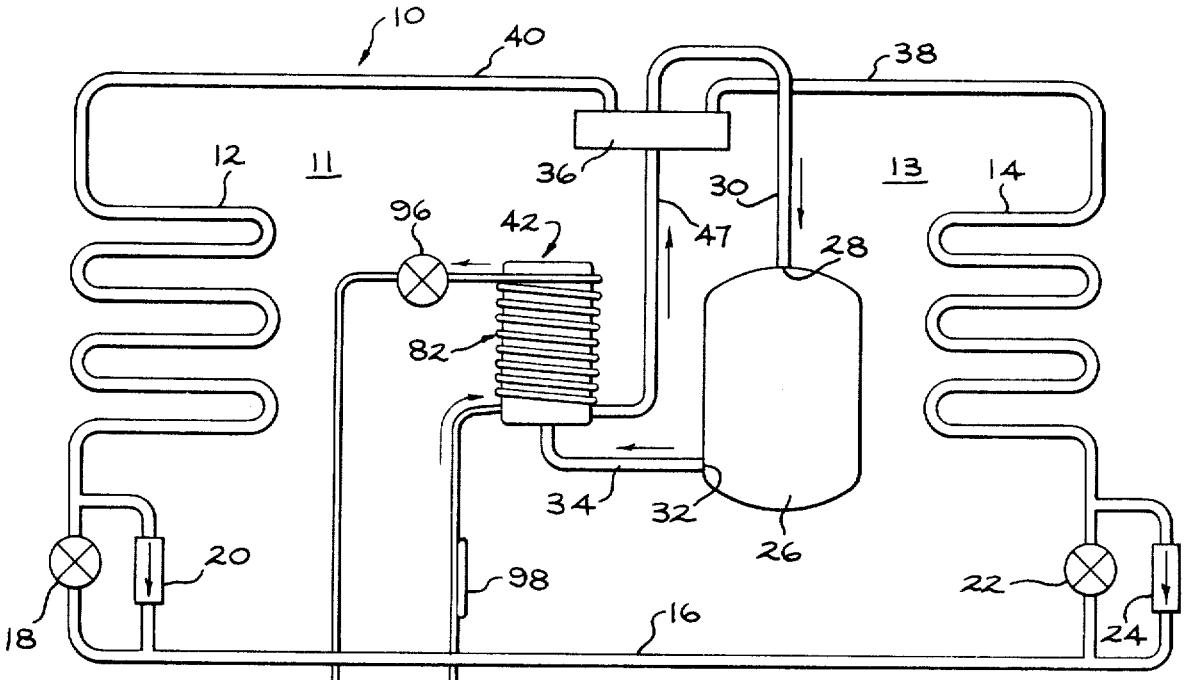
FIG. 1 is a diagrammatic illustration of a refrigerant system heat pump embodying the present invention.
Figure 2:
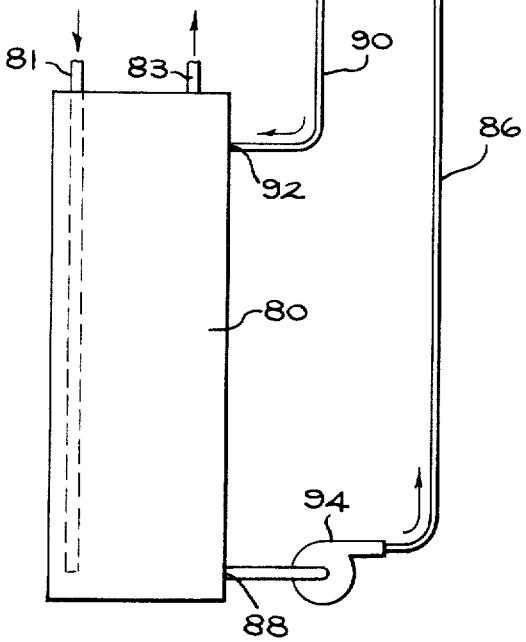
FIG. 2 is a longitudinal sectional view of the muffler water tube heat exchanger of the present invention showing details of construction.
Figure 2:
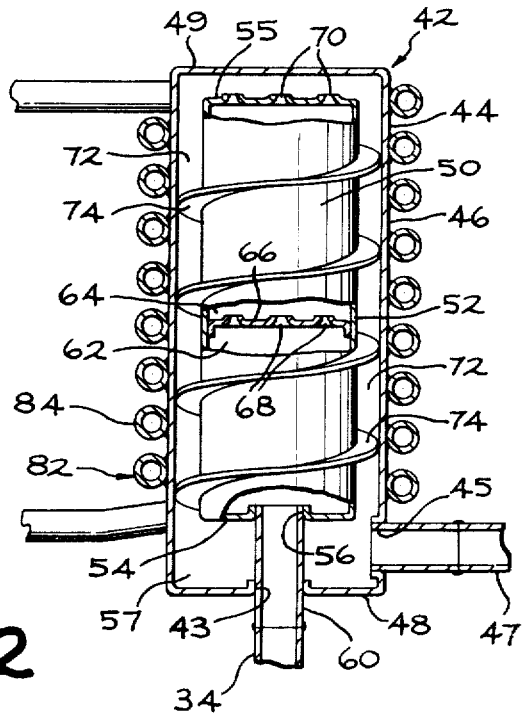

Referring to the drawing, there is shown a heat pump 10 comprising an indoor unit 11 including the indoor heat exchanger 12 and an outdoor unit 13 including the outdoor heat exchanger 14. The heat exchangers are connected at one end through a conduit 16.

The conduit 16 includes flow control or expansion means for monitoring the pressure difference between the indoor heat exchanger 12 and the outdoor heat exchanger 14. The indoor unit 11 includes flow control means in the form of an expansion valve 18 and a bypass line including a check valve 20 which bypasses refrigerant around the expansion valve 18 when the heat pump is operated as a heating unit and the indoor heat exchanger is functioning as a condenser. The outdoor unit 13 includes flow control means in the form of an expansion valve 22 and a bypass line including a check valve 24 which bypasses refrigerant around the expansion valve 22 when the heat pump unit is operating on the cooling cycle in which the outdoor heat exchanger 14 functions as a condenser. While separate expansion valves 20 and 22 are provided for controlling refrigerant flow on the heating and cooling cycles, it will be understood that as single expansion valve or equivalent flow control means may be employed.

A compressor 26 having an inlet 28 connected to a suction line 30 and an outlet 32 connected to a discharge line 34. A reversing valve 36 connected to the suction and discharge lines provide means for effecting flow of refrigerant through the refrigerant circuit including the two heat exchangers in either direction whereby the indoor unit 11 may be operated either as a heating unit in which the indoor heat exchanger 12 functions as a condenser or as a cooling unit in which the indoor heat exchanger 12 functions as an evaporator. The compressor and reversing valve in the present embodiment may be part of the outdoor unit 13 in which case the reversing valve 36 is connected to the outdoor heat exchanger by means of a conduit 38 and to the indoor heat exchanger 12 by means of a conduit 40. While a heat pump has been disclosed and described in conjunction with carrying out the present invention, it will be understood a single function refrigeration system employed in a cooling-only air conditioner may be employed in carrying out the present invention.

Means are provided by the present invention to attenuate the noise resulting from the pressure pulses in the discharge gas from compressor 26. To this end, a muffler 42 is arranged in the discharge line 34 of the heat pump 10. Muffler 42 includes an inlet 43 connected to discharge line 34 and an outlet 45 connected to line 47 leading to the system reversing valve. Refrigerant gas discharged from the compressor 26 through line 34 passes through muffler 42, line 47, in series to the reversing valve 36 where it is directed either through conduit 40 to the indoor heat exchanger 12 during the heating cycle or through conduit 38 to the outdoor heat exchanger 14 during the cooling cycle.

The muffler 42 as shown in the present embodiment of the invention includes a shell or housing 44, preferably a hollow cylinder having a side wall 46 formed about a longitudinal axis and sealed at its ends by cap members 48 and 49. Extending centrally in the housing 44 and spaced from wall 46 and end caps 48 is an interior casing 50. The casing, like housing 44, is a hollow cylinder having a side wall 52 formed about the longitudinal axis and includes end caps 54, 55. The casing is arranged concentric in the housing 44 with the walls 46 and 52 spaced apart. The end cap 55 is arranged relatively close to the end cap 49 of housing 44, while end cap 54 is spaced a sufficient distance from end cap 48 to provide a collection chamber or area 57. The end cap 54 of casing 50 is provided with an opening 56 that is concentric with inlet 43 of housing 44. A connecting tube member 60 is arranged in openings 56 and 43, and extends outwardly of the muffler 42. The discharge line 34 is connected to connector 60 so that hot refrigerant gas discharged from the compressor 26 is delivered directly into the interior of casing 50. The casing 50 may further be divided into two chambers 62 and 64 by a partition or baffle 66 which is provided with restricted apertures 68 therein affording communication between chambers 62 and 64. While only one baffle is shown, it should be noted that several baffles may be required to attain the desired level of noise attenuation and, accordingly, baffle 66 may be one of several baffles dividing the casing into a plurality of chambers. The upper or other end cap 55 of casing 50 is provided with apertures 70 affording communication between the casing interior and the interior of housing 44 from where it passes through outlet 45.

Interposed between the aperture 70 and outlet 45 is a restrictive passageway 72. The passageway 72 is formed by a helix or helically wound wall 74 that extends radially between the outer surface of wall 52 of casing 50 and the inner surface of wall 46 of housing 44. In effect, all of the gas passing through apertures 70 passes spirally through passageway 72 formed by the wall 74. The arrangement of wall 74 defines a relatively long narrow spiral inductive passage providing a high velocity gas flow that improves heat transfer to the outer housing wall 46 and insures that all of the hot gas reaches all of the inner surface of wall 46. The passageway 72 terminates at the collection area 57 which serves to improve the low frequency capability of the muffler.

In accordance with the present invention, means are also provided in combination with the muffler 42 to transfer the heat of the gas passing through the muffler to a liquid. To this end, there is arranged in heat exchange relation with the muffler housing 44 a heating coil 82. The coil 82 is in the form of a coil of tubing 84 that is helically wrapped about, and in intimate contact with the outer wall 46 of housing 44. The two elements, muffler 42 and coil 82, together form a heat exchanger in which liquid passing through the tubing 84 of the coil 82 may be heated. The transfer of heat from the hot housing 44 to the coil 82 can be increased by soldering the tube 84 and filling the space between the tube turns with solder or other fused metal. The direction of flow of hot refrigerant gas through the passageway 72 in one direction and the fluid flow through the tubing of coil 82 in the opposite direction provides optimum heat exchange in a counter flow arrangement between the liquid in coil 82 and the hot gas in muffler 42.

The coil of tubing 84 receives liquid, typically water from a water heater tank 80. The water heating tank 80 may be of any conventional construction and includes a water inlet 81 and outlet 83. The water heater may include a primary heat source (not shown) and the present arrangement employed as a secondary or auxiliary heat means used to supplement the primary heating means. Water from the tank 80 is introduced into the coil 84 by way of a conduit 86 whose intake end 88 is located at or near the bottom of the closed tank 80 and recirculated back to the tank by way of a conduit 88 whose outlet end 92 is located at or near the top of the closed tank 80.

In operation with the refrigeration system energized a motor drive pump 94 causes a portion of the water in tank 80 to circulate through the coil 84 raising the temperature of the recirculating water by its hot exchange relationship with the hot refrigerant discharge gas passing through muffler 42. This heated water is then returned to tank 80.

Means are provided to insure that water is recirculated through coil 84 only when the water temperature is at least 140° and prevented from recirculating when the water temperature is 180° or higher. To this end, a temperature controlled water valve 96 is arranged in line 90 that is set to open at substantially 140°. A temperature sensitive sensor 98 is arranged on conduit 86 that effectively deenergizes the pump 94 when the temperature of the water being recirculated is at substantially 180° F. The temperatures 140° and 180° are merely representative of average minimum and maximum temperatures and other temperatures may be selected as desired.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A muffler for a refrigeration system having heat exchange means being adapted to be connected to a water source, said refrigeration system including a compressor, a condenser for condensing hot gaseous refrigerant discharged from said compressor, an evaporator for evaporating said condensed refrigerant, said muffler comprising:

a cylindrical housing, a cap portion closing each end of said housing;

an inlet on said housing connected to the refrigerant system for receiving said hot gaseous refrigerant and an outlet arranging said housing in series flow in said refrigeration system;

a tubular casing arranged in said housing having its longitudinal wall spaced from the interior wall of said housing;

a cap on one end of said casing including an inlet, means connecting said inlet to said housing inlet for directing said hot gaseous refrigerant into said casing;

a cap on the other end of said casing including a plurality of outlet apertures for delivering said hot gaseous refrigerant to the interior of said housing;

a helical wall extending between the casing outer wall and housing interior wall to form a passage for said hot gaseous refrigerant between the outlet aperture of said casing and said housing inlet to return said hot gaseous refrigerant to said refrigerant system; and a water passageway connected to said water source being arranged in heat exchange relationship with the outer surface of said housing being heated by said hot gaseous refrigerant to increase the temperature of said water as it flows through said water tube.

2. The muffler for a refrigeration system recited in claim 1 further including a partition having a plurality of apertures dividing said tubular casing.

3. The muffler for a refrigeration system recited in claim 2 wherein said water passageway is a tube in coil form helically wound in intimate contact with the outer wall of said cylindrical housing.

4. The muffler for the refrigeration system recited in claim 3 wherein said hot gaseous refrigerant flow through said passage is in one longitudinal direction relative to said muffler and said water flow through said tube in coil form is in the other longitudinal direction relative to said muffler.

5. In a refrigeration system including a compressor, a discharge line for receiving hot gaseous refrigerant from said compressor, a condenser, an evaporator and a suction line connected to said compressor in series to form a closed refrigerant circuit, a muffler connected in said discharge line including heat exchange means adapted to be connected to a water source, said muffler comprising:

a cylindrical housing having end portions closing said housing;

an inlet in said housing connected to secure hot gaseous refrigerant from said discharge line;

an outlet in said housing connected to return the hot gaseous refrigerant to said discharge line;

a cylindrical casing arranged in said housing having its longitudinal walls spaced from the interior walls of said housing;

a cap on one end of said casing including an inlet, means connected to said housing inlet to divert said hot gaseous refrigerant to the interior of said casing;

an outlet cap on the other end of said casing being provided with openings for discharging said hot gaseous refrigerant into said housing interior;

a partition dividing the interior of said casing, said partition having a plurality of apertures;

a helical wall extending between the housing and casing to form a passage between the casing and housing between said outlet opening in said other end of said casing and said housing outlet; and a water passageway arranged in heat exchange relationship with the outer surface of said housing being heated by said hot gaseous refrigerant to increase the temperature of said water as it flow through said water tube.

6. In the refrigeration system recited in claim 5 wherein said muffler further includes a partition having a plurality of apertures dividing said tubular casing.

7. The refrigeration system recited in claim 6 wherein said water passageway is a tube in coil form helically wound in intimate contact with the outer wall of said cylindrical housing.

8. The refrigeration system recited in claim 7 wherein said hot gaseous refrigerant flow through said passage is in one longitudinal direction relative to said muffler and said water flow through said water tube in coil form is in the other longitudinal direction relative to said muffler.

9. In the refrigeration system recited in claim 8 wherein said system is a heat pump further including a reversing valve for reversibly connecting said compressor to said heat exchanger for effecting flow through said system in either direction whereby said system may be operated on a cooling cycle with said first heat exchanger functioning as an evaporator or on a heating cycle with said second heat exchanger functioning as an evaporator.

10. A refrigeration system comprising:

a first heat exchanger;

a second heat exchanger;

a conduit including flow restricting means serially connected with said heat exchangers;

means including a compressor having a suction line for withdrawing low pressure refrigerant from said first heat exchanger and discharging hot gaseous refrigerant to said second heat exchanger;

a muffler connected for receiving hot gaseous refrigerant including:

(a) a cylindrical housing, a cap portion at each end of said housing, (b) an inlet on said housing connected to the hot gaseous refrigerant source and an outlet arranging said housing in series flow between said compressor and said second heat exchanger, (c) a tubular casing arranged in said housing having its longitudinal walls spaced from the interior walls of said housing, (d) a cap on one end of said casing including an inlet, (e) means connecting said casing inlet to said housing inlet for receiving said gaseous refrigerant, (f) a helical wall extending between the casing outer wall and housing interior wall to form a passage between the outlet aperture of said casing and said housing inlet, and (g) a water heat exchanger means adapted to be connected to a water source including a water tube arranged in heat exchange relationship with the outer surface of said housing being heated by said gaseous refrigerant to increase the temperature of said water as it flows through said water tube.

11. A refrigeration system recited in claim 10 wherein said muffler includes a partition having a plurality of apertures dividing said tubular casing.

12. A refrigeration system recited in claim 11 wherein said water tube is in coil form helically wound in intimate contact with the outer wall of said cylindrical housing.

13. The refrigeration system recited in claim 12 wherein said hot gaseous refrigerant flow through said passage is in one longitudinal direction relative to said muffler and said water flow through said coil form is in the other longitudinal direction relative to said muffler.

* * * * *